US008366162B2

(12) United States Patent
Imlach et al.

(10) Patent No.: US 8,366,162 B2
(45) Date of Patent: Feb. 5, 2013

(54) RETRIEVAL SYSTEMS AND METHODS FOR FLOATING OBJECTS

(75) Inventors: Joseph Imlach, Anchorage, AK (US); Weston S. Smith, Eagle River, AK (US); Tracy DeVoll, Wasilla, AK (US); Marian Ilene DeVoll, legal representative, Wasilla, AK (US)

(73) Assignee: Alaska Native Technologies, LLC, Anchorage, AK (US)

( * ) Notice: Subject to any disclaimer, the term of this patent is extended or adjusted under 35 U.S.C. 154(b) by 119 days.

(21) Appl. No.: 13/086,336

(22) Filed: Apr. 13, 2011

(65) Prior Publication Data

US 2011/0254302 A1 Oct. 20, 2011

Related U.S. Application Data

(60) Provisional application No. 61/324,016, filed on Apr. 14, 2010.

(51) Int. Cl.
*B66C 1/30* (2006.01)

(52) U.S. Cl. ..... 294/118; 294/110.1

(58) Field of Classification Search ..... 294/67.5, 294/110.1, 115, 118, 119, 902; 414/626, 414/729, 732, 739; 901/39
See application file for complete search history.

(56) References Cited

U.S. PATENT DOCUMENTS

| | | | | | |
|---|---|---|---|---|---|
| 554,714 | A | * | 2/1896 | Murphy | 294/118 |
| 1,737,614 | A | * | 12/1929 | Peck | 294/106 |
| 2,378,570 | A | * | 6/1945 | Mitchell | 294/117 |
| 2,384,396 | A | * | 9/1945 | Peyer | 294/110.1 |
| 2,561,207 | A | * | 7/1951 | Kellner | 294/119 |
| 3,397,907 | A | * | 8/1968 | Trowbridge | 294/118 |
| 4,030,625 | A | * | 6/1977 | Koehnen | 294/118 |
| 4,055,138 | A | | 10/1977 | Klein | |
| 5,253,605 | A | | 10/1993 | Collins | |
| 5,447,115 | A | | 9/1995 | Moody | |
| 6,012,752 | A | * | 1/2000 | Douglas | 294/110.1 |
| 6,502,527 | B1 | | 1/2003 | Danielson | |
| 6,600,695 | B1 | | 7/2003 | Nugent et al. | |
| 7,213,798 | B1 | | 5/2007 | Thompson et al. | |
| 7,506,606 | B2 | | 3/2009 | Murphy et al. | |

* cited by examiner

*Primary Examiner* — Paul T Chin
(74) *Attorney, Agent, or Firm* — Michael R. Schacht; Schacht Law Office, Inc.

(57) ABSTRACT

A system for displacing a floating object comprising a jaw assembly and at least one latch assembly. The jaw assembly supports the latch assembly such that, when the latch assembly is in a latched configuration, the latch assembly maintains the jaw assembly in an open configuration and, when the jaw assembly is in the open configuration, the at least one jaw assembly defines a jaw gap through which the floating object may pass. The latch assembly is adapted to engage the floating object when the floating object has passed through the jaw gap such that the latch assembly is placed from the latched position into the unlatched position to allow the jaw assembly to move from the open configuration into the closed configuration. The jaw assembly is adapted to engage the floating object when in the closed configuration.

21 Claims, 9 Drawing Sheets

RETRIEVAL SYSTEMS AND METHODS FOR FLOATING OBJECTS

RELATED APLICATIONS

This application claims priority to U.S. Provisional Patent Application Ser. No. 61/324,016, filed Apr. 14, 2010.

The contents of the related application(s) listed above are incorporated herein by reference.

TECHNICAL FIELD

The present invention relates to systems and methods for lifting objects and, more particularly, to vessel mounted systems and methods for lifting objects from the water and into the vessel.

BACKGROUND

It is often necessary to lower objects into and lift objects from the water. For example, maritime research projects frequently employ a glider the buoyancy of which can be controlled to allow the glider to move within a body of water to collect data. Such gliders are typically elongate devices that are configured to float on the surface of the body of water during release and/or retrieval. The present invention is of particular significance when employed to release and/or retrieve gliders, and that application of the present invention will be described herein in detail.

Typically, objects such as gliders are released and retrieved using a watercraft such as a research vessel. Such research vessels are typical typically provided with a small crane or "davit" that suspends a line above the water.

The need exists for improved systems and methods for allowing a line suspended from a davit to be connected to and disconnected from a floating object such as a glider to facilitate release and/or retrieval of the glider.

SUMMARY

The present invention may be embodied as a system for displacing a floating object comprising at least one jaw assembly, a latch assembly, and a lift assembly. The at least one jaw assembly is operable in an open configuration and a closed configuration, and the latch assembly is operable in a latched configuration and an unlatched configuration. The lift assembly is connected to the at least one jaw assembly to allow lifting and lowering of the at least one jaw assembly. The at least one jaw assembly supports the latch assembly such that, when the latch assembly is in the latched configuration, the latch assembly maintains the at least one jaw assembly in the open configuration. When the at least one jaw assembly is in the open configuration, the at least one jaw assembly defines a jaw gap through which the floating object may pass. The latch assembly is adapted to engage the floating object when the floating object has passed through the jaw gap such that the latch assembly is placed from the latched position into the unlatched position. When the latch assembly is placed from the latched position into the unlatched position, the latch assembly allows the at least one jaw assembly to move from the open configuration into the closed configuration. The at least one jaw assembly is adapted to engage the floating object when in the closed configuration and thereby allow the lifting assembly to displace the at least one jaw assembly and the floating object.

The present invention may also be embodied as a method for displacing a floating object comprising the following steps. At least one jaw assembly operable in an open configuration and a closed configuration is provided. When the at least one jaw assembly is in the open configuration, the at least one jaw assembly defines a jaw gap through which the floating object may pass. A latch assembly operable in a latched configuration and an unlatched configuration is provided. The latch assembly is supported on the at least one jaw assembly such that, when the latch assembly is in the latched configuration, the latch assembly maintains the at least one jaw assembly in the open configuration, and, when the latch assembly is placed from the latched position into the unlatched position, the latch assembly allows the at least one jaw assembly to move from the open configuration into the closed configuration. A lift assembly is connected to the at least one jaw assembly. The latch assembly is arranged in the latched configuration is such that the at least one jaw assembly is in the open configuration. The lift assembly is operated such that the object passes through the jaw gap and engages the latch assembly to place the latch assembly in the unlatched configuration and allow the at least one jaw assembly to move from the open configuration to the closed configuration. The lifting assembly is the operated to displace the jaw assemblies and the floating object.

The present invention may also be embodied as a system for engaging a floating object comprising at least one jaw assembly and a latch assembly. The at least one jaw assembly is operable in an open configuration and a closed configuration. The latch assembly comprises a release plate and is operable in a latched configuration and an unlatched configuration. The at least one jaw assembly supports the latch assembly such that, when the latch assembly is in the latched configuration, the latch assembly maintains the at least one jaw assembly in the open configuration. When the at least one jaw assembly is in the open configuration, the at least one jaw assembly defines a jaw gap through which the floating object may pass. The latch plate of the latch assembly is adapted to engage the floating object when the floating object has passed through the jaw gap such that the latch assembly is placed from the latched position into the unlatched position. When the latch assembly is placed from the latched position into the unlatched position, the latch assembly allows the at least one jaw assembly to move from the open configuration into the closed configuration. The at least one jaw assembly is adapted to engage the floating object when in the closed configuration and thereby allow the lifting assembly to displace the at least one jaw assembly and the floating object.

DETAILED DESCRIPTION

Figure 1:
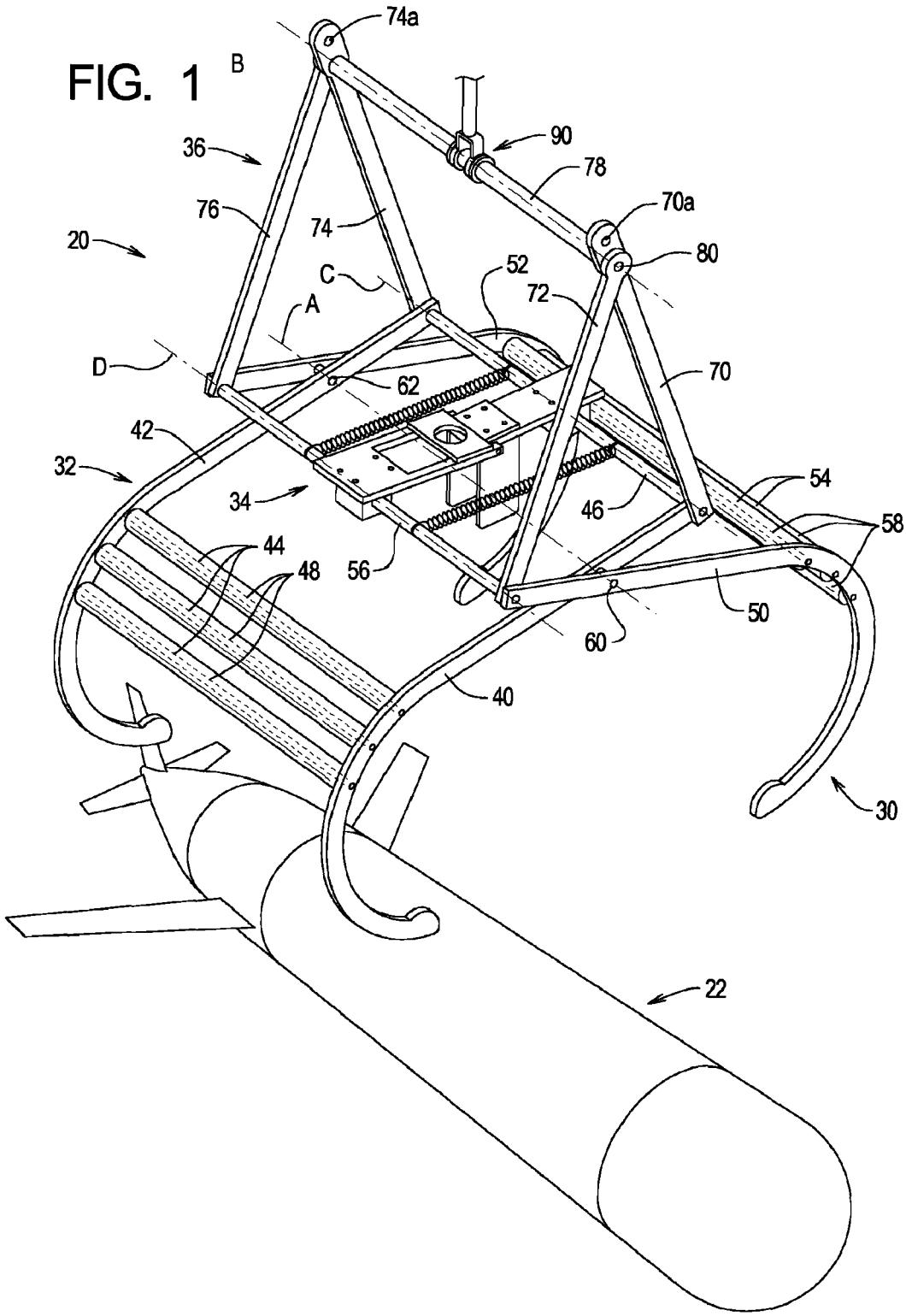
FIG. 1 is a perspective view of a retrieval device of the present invention and an object to be retrieved by the retrieval device.

Referring initially to FIG. 1 of the drawing, depicted therein is an example retrieval device 20 constructed in accordance with, and embodying, the principles of the present invention. The example retrieval device 20 is adapted to retrieve an example object 22. As will be described in further detail below, the retrieval device 20 suspended from a davit or the like on a vessel such as a boat. The vessel and davit are or may be conventional and are not shown in the drawings. The example object 22 is a glider that can be controlled to float on the surface of a body of water. The retrieval device 20 facilitates the retrieval of the object 22 from the water surface and into the vessel from which the device 20 is suspended.

As shown in FIG. 1, the example retrieval device 20 comprises a first jaw assembly 30, a second jaw assembly 32, a latch assembly 34, and a lift assembly 36. As will be described in further detail below, the lift assembly 36 secures the jaw assemblies 30 and 32 to a line.

Figure 3:
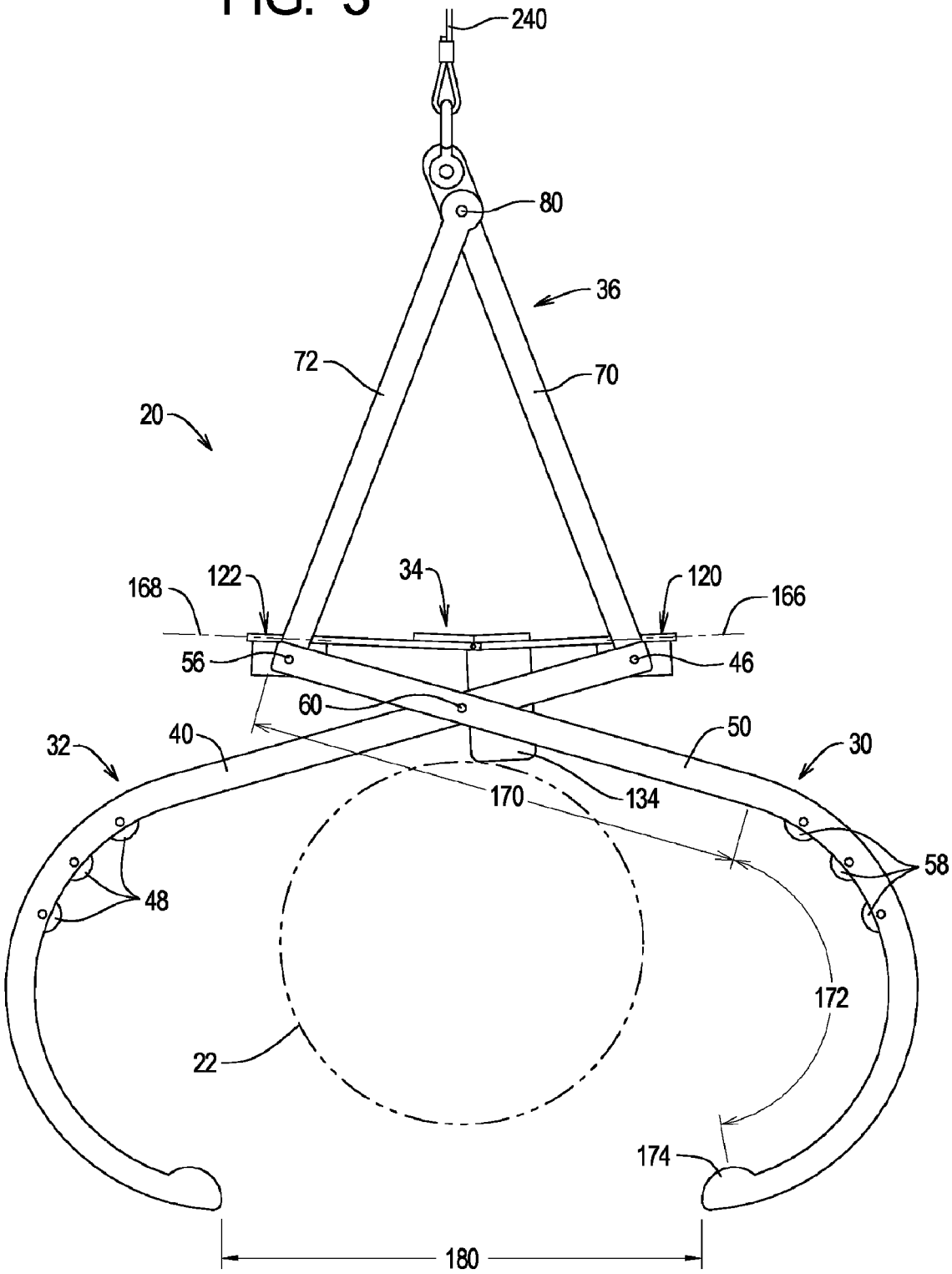
FIGS. 3 and 4 are side elevation views illustrating the retrieval device of FIG. 1 in open and closed configurations.
Figure 4:
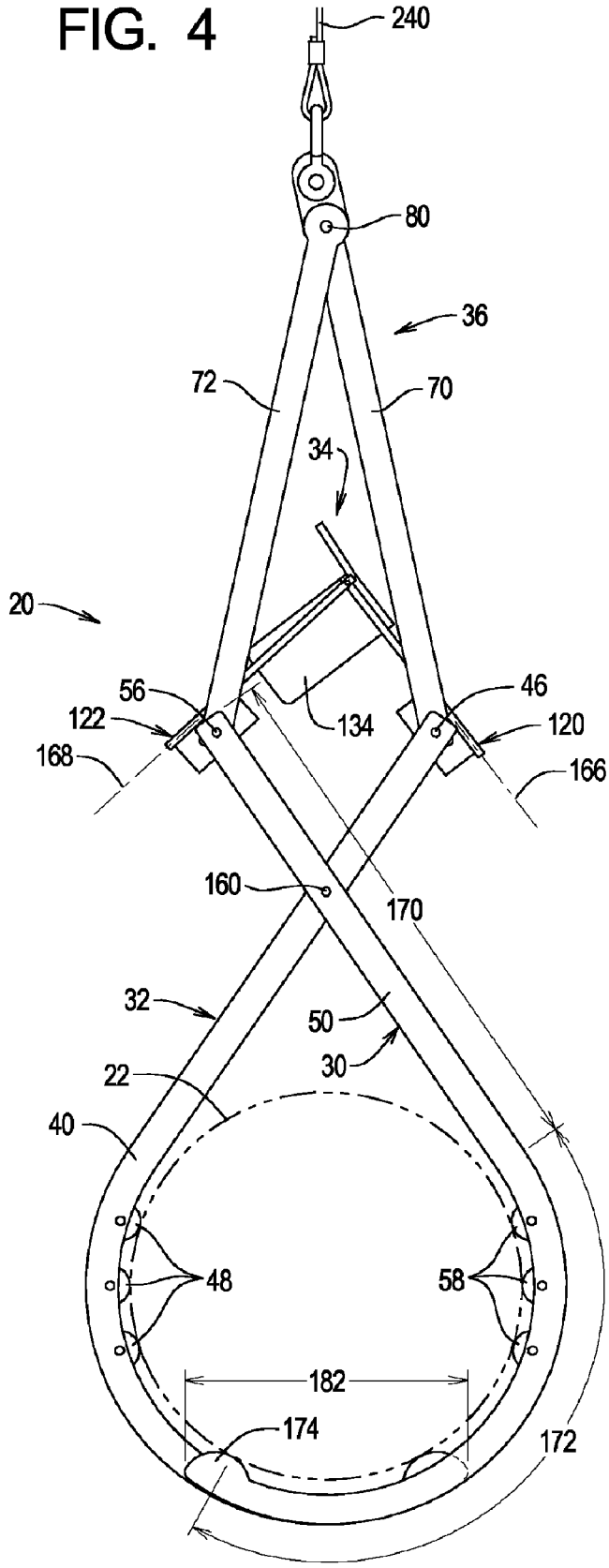

As shown in FIG. 3, the latch assembly 34 may be placed in a latch configuration in which the first and second jaw assemblies 30 and 32 are held in an open configuration. When the latch assembly 34 is tripped from the latched configuration to an unlatched configuration, the latch assembly 34 allows the first and second jaw assemblies 30 and 32 to rotate from the open configuration into a closed configuration as shown in FIG. 4.

In the open configuration, the retrieval device 20 can be displaced such that the object 22 is between portions of the jaw assemblies 30 and 32. When in a predetermined configuration relative to the jaw assemblies 30 and 32 as shown in FIG. 3, the object 22 trips the latch assembly 34, allowing the jaw assemblies 30 and 32 to rotate into the closed configuration such that at least portions of the jaw assemblies 30 and 32 partly surround the object 22. At this point, raising of the jaw assemblies 30 and 32 raises the object 22.

Given the foregoing general understanding of the operation of the example retrieval device 20, the details of this example device 20 will now be described in further detail.

The first jaw assembly 30 comprises a first jaw member 40, a second jaw member 42, one or more first distal spacers 44, a first proximal spacer 46, and, optionally, roller members 48 covering the distal spacers 44. The second jaw assembly 32 comprises a third jaw member 50, a fourth jaw member 52, one or more second distal spacers 54, and a second proximal spacer 56. Again, roller members 58 may optionally be configured to cover the distal spacers 54. The spacers 44, 46, 54, and 56 join the jaw members 40,42, 50, and 52 together in a substantially aligned, parallel arrangement to form the first and second jaw assemblies 30 and 32, respectively.

The first and second jaw assemblies 30 and 32 are connected by a first main hinge member 60 and a second main hinge member 62 such that the first and second jaw assemblies 30 and 32 pivot relative to each other about a main axis A.

FIG. 1 illustrates that the lift assembly comprises first, second, third, and fourth lift members 70, 72, 74, and 76 and a lift bar 78. Upper ends of the first and second lift members 70 and 72 are connected to a first end of the lift bar 78, while upper ends of the third and fourth lift members 74 and 76 are connected to a second end of the lift bar 78. A lift hinge member 80 extends through the lift bar 78 to define a lift axis B as shown in FIG. 1. A pole coupler 90 is arranged to facilitate displacement of the jaw assemblies 30 and 32 into their open and closed configurations. Eyelets 70*a* and 74*a* are formed in the upper ends of the first and third lift members 70 and 74.

Lower ends of the first and third lift members 70 and 74 are connected to opposite ends of the first proximal spacer 46 for relative rotation about a first jaw axis C, and lower ends of the second and fourth lift members 72 and 76 are connected to opposite ends of the second proximal spacer 56 for relative rotation about a second jaw axis D. Rotation of the first and second jaw assemblies 30 and 32 about the main axis A relative to each other causes rotation of the first and third lift members 70 and 74 relative to the second and fourth lift members 72 and 76 about the lift axis B.

The construction and operation of the example latch assembly 34 will now be described in further detail with reference to FIGS. 2-4. As to shown in FIG. 2, the example latch assembly 34 comprises a first latch plate assembly 120, a second latch plate assembly 122, a latch pin 124, and first and second latch springs 126 and 128.

The first latch plate assembly 120 comprises a first latch plate 130, a first connecting block 132, a first release plate 134, a second release plate 136, and a center plate 138. The second latch plate assembly 122 comprises a second latch plate 140 and a second connecting block 142.

The connecting blocks 132 and 142 are rigidly connected to the latch plates 130 and 140, respectively. The first connecting block 132 pivotably connects the first latch plate 130 to the first proximal spacer 46, and the second connecting block 142 connects the second latch plate 140 to the second proximal spacer 56. The example release plates 134 and 136 extend substantially perpendicularly from a bottom surface of the first latch plate 130 as will be described in further detail below.

The example first latch plate 130 is a substantially solid rectangular plate. The second latch plate 140 comprises a main portion 150 and first and second arm portions 152 and 154. A latch space 156 is defined between the first and second arm portions 152 and 154.

The example center plate 138 comprises a first portion 160 and a second portion 162. The first portion 160 of the center plate 138 is rigidly connected to an upper surface of the first latch plate 130. The first portion 160 of the center plate 138 defines a first plate plane 166, while the second portion 162 of the center plate 138 defines a second plate plane 168.

The latch pin 124 connects a distal end of the first latch plate 130 to distal ends of the arm portions 152 and 154 of the second plate 140. With the first and second latch plates 130 and 140 connected, the second portion 162 of the center plate 138 extends from the first latch plate 130 towards the latch space 156 defined by the arm portions 152 and 154 of the second latch plate 140.

Referring now to FIGS. 1, 3, and 4 of the drawing, it can be seen that the example jaw members 40, 42, 50, and 52 are substantially the same shape. Accordingly, only the third example jaw member 50 will be described herein, with the understanding that this description applies to all of the example jaw members 40, 42, 50, and 52.

For a substantially cylindrical object such as the example object 22, the third example jaw member 50 comprises a straight portion 170, a curved portion 172, and a tip portion 174. The straight portion 170 and curved portion 172 are approximately the same in cross-sectional area, while the tip portion is slightly enlarged in cross-sectional area in comparison to the straight and curved portions 170 and 172.

Figure 2:
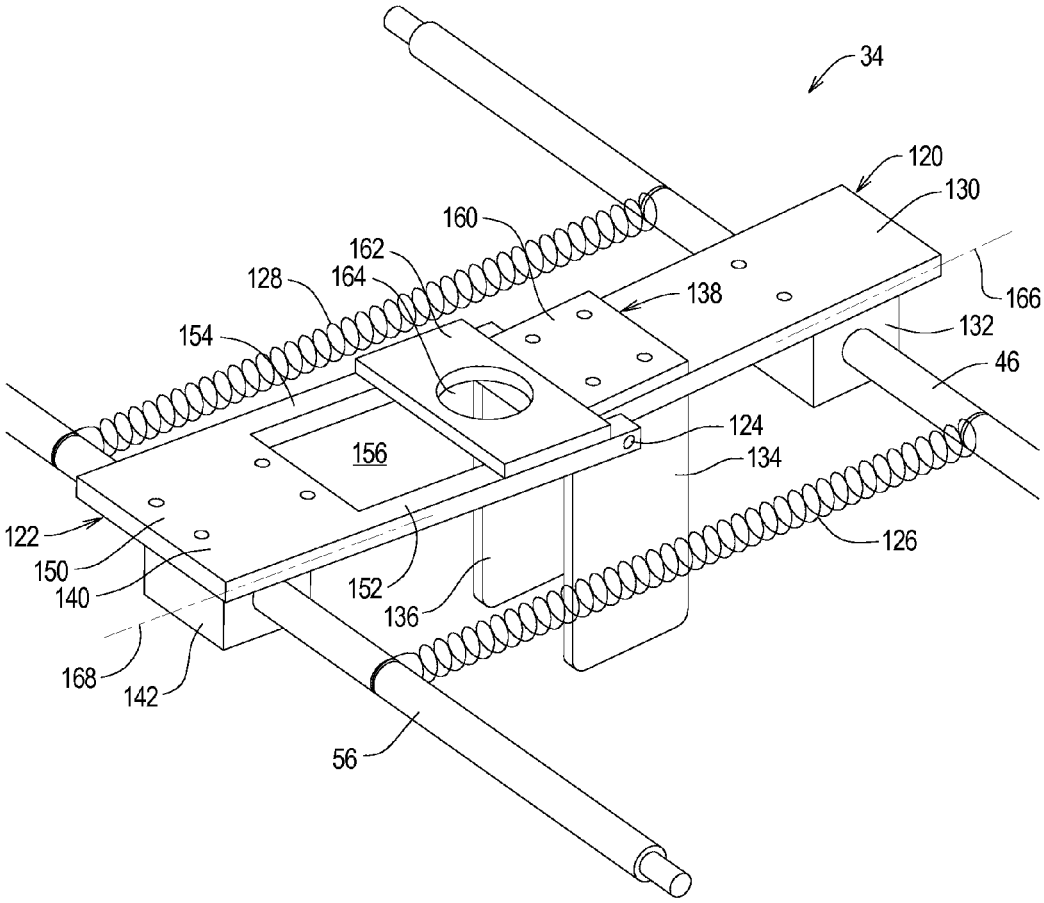
FIG. 2 is a close up view of a latch assembly of the retrieval device of FIG. 1.
Figure 5:
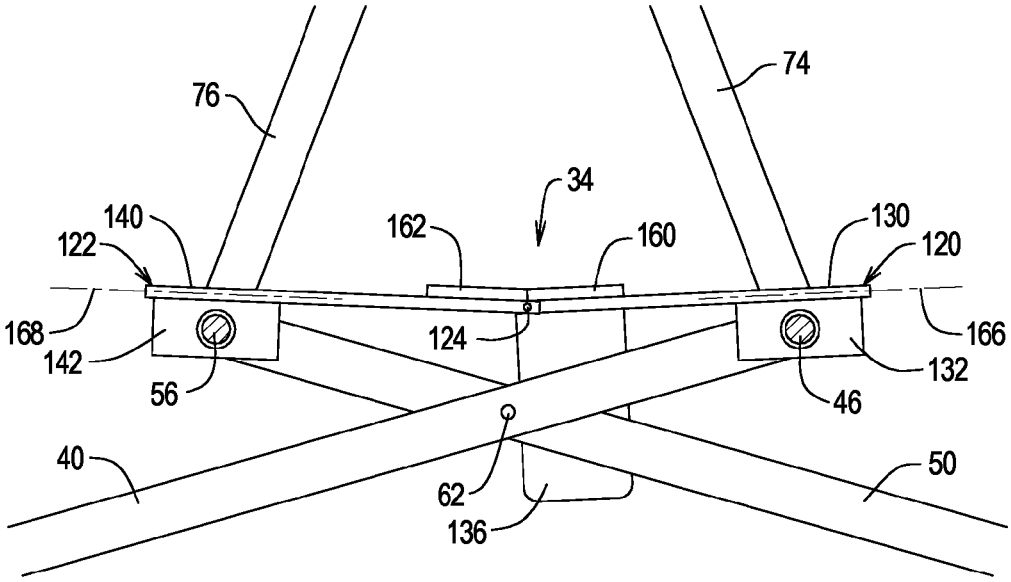
FIG. 5 is a side elevation view of the latch system of the retrieval device in the open configuration.
Figure 6:
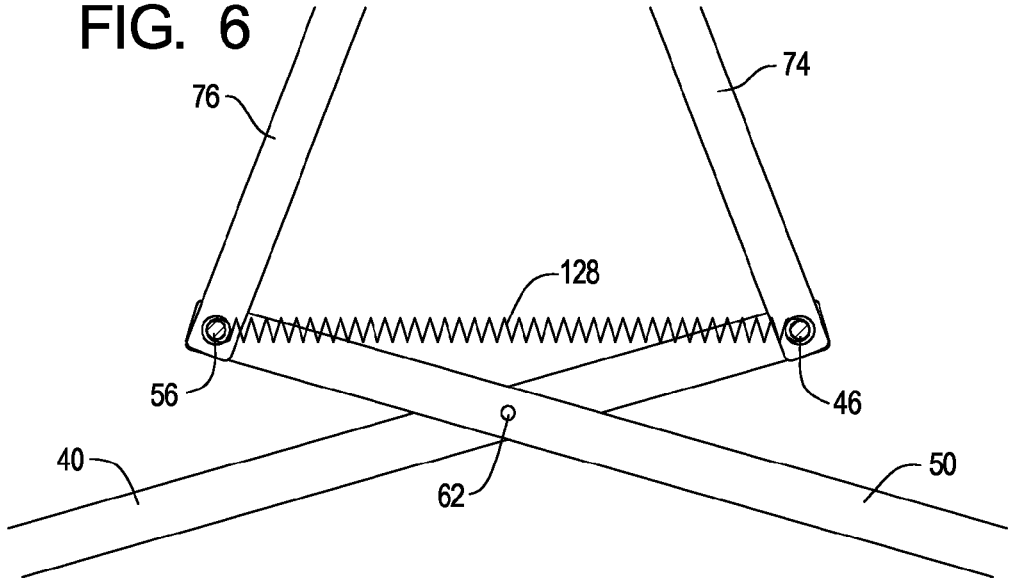
FIG. 6 is a side elevation view of the latch springs of the retrieval device in the open configuration.
Figure 7:
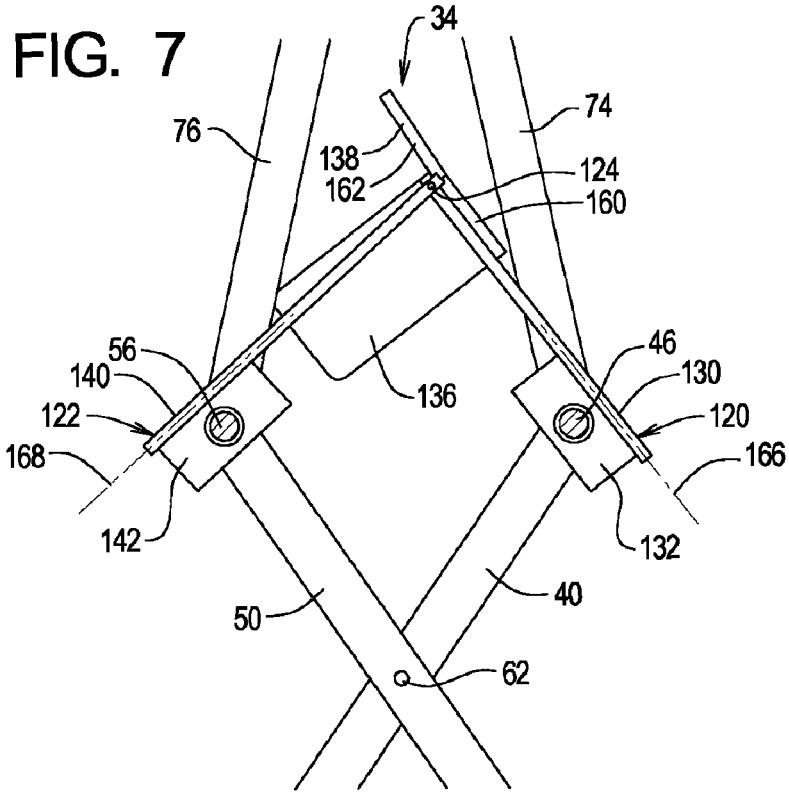
FIG. 7 is a side elevation view of the latch system of the retrieval device in the closed configuration.
Figure 8:
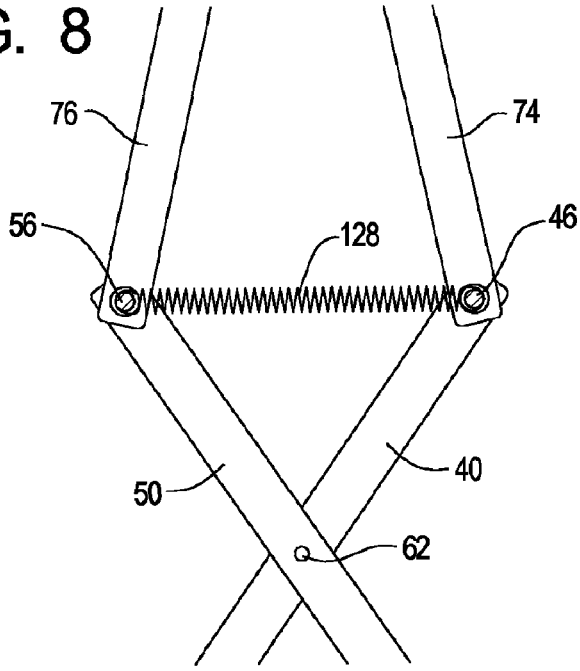
FIG. 8 is a side elevation view of the latch springs of the retrieval device in the closed configuration.

The latch assembly 34 is shown in the latched configuration in FIGS. 2, 3, and 5. In the latched configuration, the first and second latch plates 130 and 140 are rotated such that the second portion 162 of the center plate 138 rests on the arm portions 152 and 154. In this position, the first and second plate planes 166 and 168 are slightly offset from or canted with respect to each other by a small angle. In addition, the latch plates 130 and 140 rotate slightly past horizontal such that the first and second plate planes 166 and 168 are slightly angled downward toward the center of the latch assembly 34.

In the latched configuration, the latch assembly 34 holds the plates 130 and 140 such that a first predetermined distance is maintained between the connecting blocks 132 and 142 and thus the first and second proximal spacers 46 and 56. The slight downward cant of the latch plates 130 and 140 and the weight of the jaw assemblies 30 and 32 effectively locks the latch assembly 34 in the latched configuration.

The latch springs 126 and 128 are sized, dimensioned, and arranged to bias the first and second proximal spacers 46 and 56 towards each other. So, in the latched configuration, the latch assembly 34 holds the first and second proximal spacers 46 and 56 apart against the bias force applied by the latch springs 126 and 128.

When the first and second proximal spacers 46 and 56 are spaced from each other the first predetermined distance, the first and second jaw assemblies 30 and 32 are rotated about the main axis A such that the retrieval device 20 is in its open configuration. In this open configuration, a jaw gap 180 is defined by the tip portions 174 of the jaw members 40, 42, 50, and 52. By maintaining the first predetermined distance between the first and second proximal spacers 46 and 56, the latch assembly 34 thus maintains the jaw gap 180, allowing the retrieval device 20 to be displaced such that the object 22 passes through this gap 180 and between the jaw assemblies 30 and 32.

At the point shown in FIG. 3, the object 22, which has passed through the gap 180, comes into contact with one or both of the release plates 134 and 136. When this occurs, further displacement of the retrieval device 20 relative to the object 22 applies an upward force on the first latch plate assembly 120 through the release plates 134 and 136 extending from the first latch plate 130. The upward force on the first latch plate assembly 120 causes the first latch plate 130 to rotate upward about the axis C. Because the first latch plate 130 is rotatably attached to the second latch plate 140 by the latch pin 124, upward rotation of the first latch plate 130 about the axis C causes the second latch plate 140 to rotate upward about the axis D.

After a short initial period of upward rotation by the first and second latch plates 130 and 140, the latch plate planes 166 and 168 pass through horizontal, slightly increasing the distance between the proximal spacers 46 and 56 and applying additional tension on the latch springs 126 and 128. Continued upward rotation of the first and second latch plates 130 and 140 past horizontal places the latch assembly 34 in its unlatched configuration. In the unlatched configuration, the springs 126 and 128 pull the proximal spacers 46 and 56 towards each other. By displacing the proximal spacers towards each other, the jaw assemblies 30 and 32 are rotated about the main axis A into the closed configuration.

When the jaw assemblies 30 and 32 are in the closed configuration, the jaw members 40 and 42 overlap with the jaw members 50 and 52 in an overlap region 182 as shown in FIG. 4. The jaw members 40, 42, 50, and 52 thus completely encircle the object 22. The object 22 is supported within the jaw assemblies 30 and 32 by the example roller members 48 and 58 and the tip portions 174. Applying an upward load on the lift bar 78 allows the object to be lifted to displace the object 22. In this manner, the object 22 can be retrieved from the surface of the water and placed in a vessel.

Figure 9:
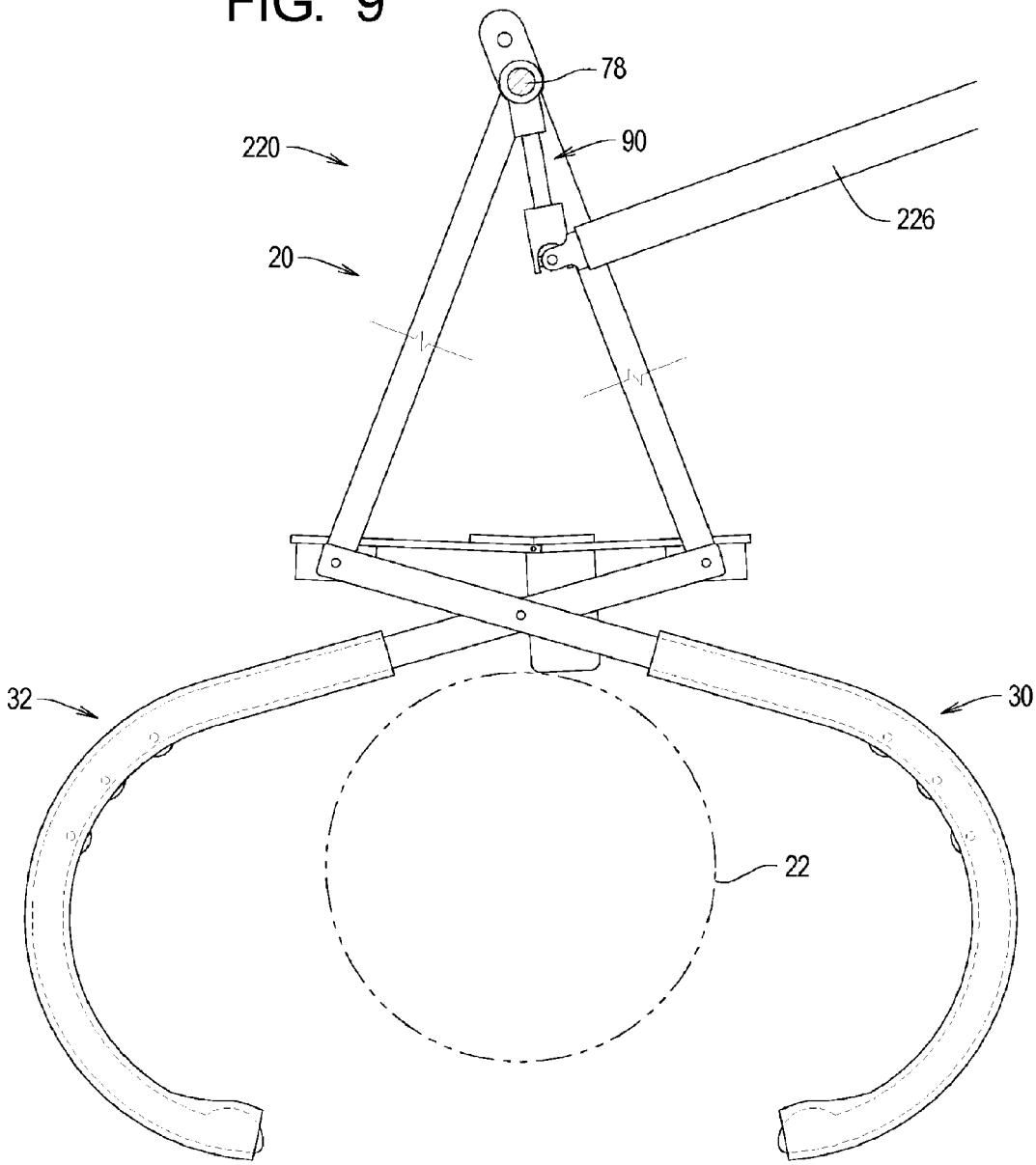
FIGS. 9 and 10 are side elevation views of a retrieval system incorporating the retrieval device of FIG. 1.
Figure 10:
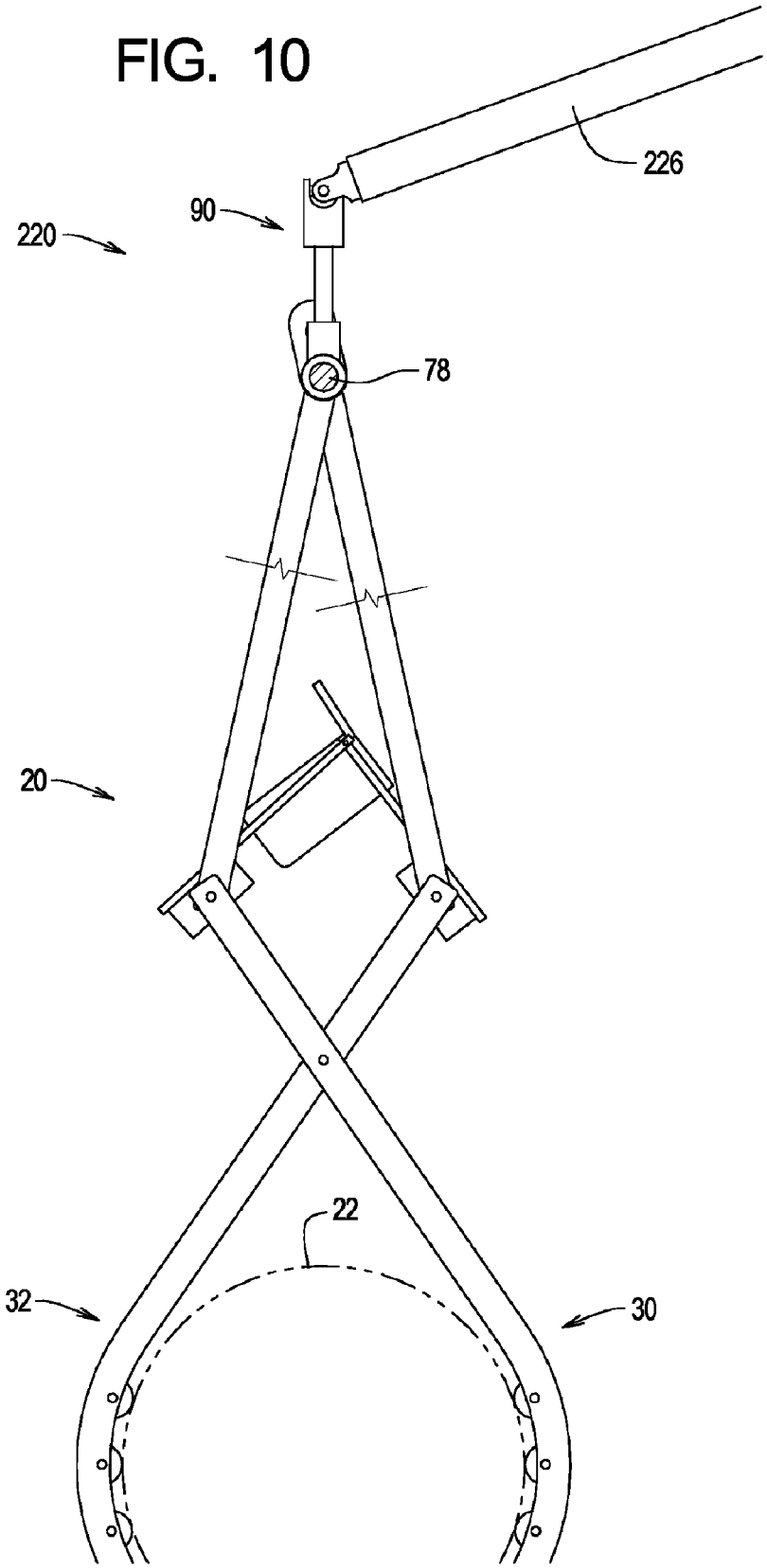
Figure 11:
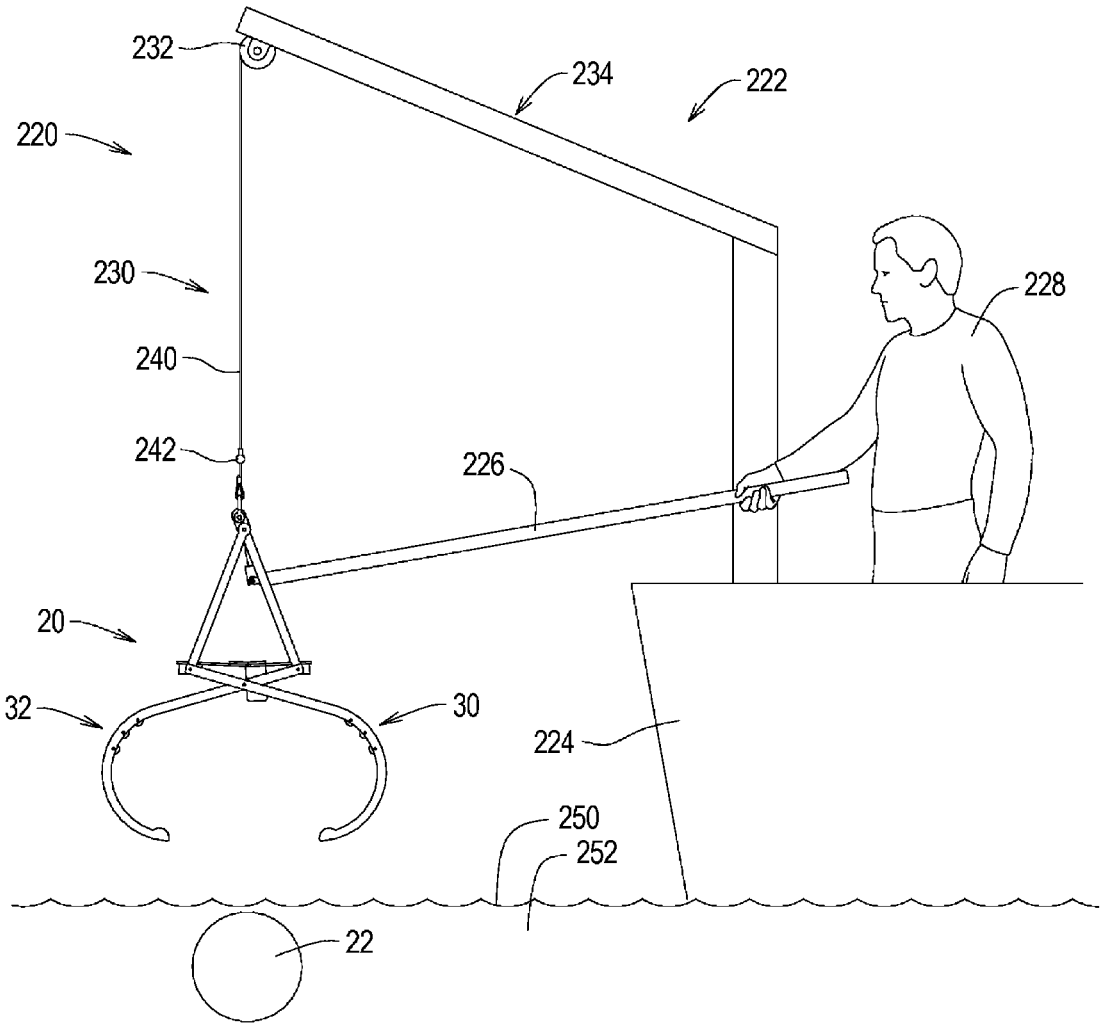
FIG. 11 is a somewhat schematic elevation view of the retrieval system of FIGS. 9 and 10.

Referring now to FIGS. 9-11, depicted therein is an example retrieval system 220 incorporating the example retrieval device 20 depicted above. The example retrieval system 220 comprises, in addition, to the retrieval device 20, a crane or davit system 222 mounted on a boat 224 and a pole 226. An operator 228 within the boat 224 operates the davit system 222 and pole 226 to configure the jaw assemblies 30 and 32 in the open and closed configurations to facilitate deployment and retrieval of the object 22.

In particular, the davit system 222 comprises a line system 230 supported by a pulley 232 of a davit structure 234. The example davit structure 234 is or may be conventional and typically comprises a hand or powered winch (not shown) for displacing and/or securing the line system 230 relative to the davit structure 234. The example line system 230 comprises a line 240 coupled to a line bar 242. The line bar 242 is in turn coupled at each end to the eyelets 70*a* and 74*a* formed in the ends of the members 70 and 74.

Referring initially to FIG. 11, it can be seen that the operator 228 stands in the boat 224. The davit structure 234 extends out from the boat 224 over a surface 250 of a body of water 252 in which the object 22 is floating. The boat 224 is displaced until the davit pulley 232 is substantially above the object 22. At this point, the line 240 extends over the davit pulley 232 and is secured relative to the davit structure 234 such that the retrieval device 20 is suspended below the davit pulley 232. When the davit pulley 232 is arranged above the object 22, the retrieval device 220 is suspended above the object 22.

The pole 226 is sized and dimensioned to allow the operator 228 to stand in the boat 224 and reach the retrieval device 20 when the device 20 is suspended over the object 22. At this point, the operator 228, using the pole 226, displaces the retrieval device 20 such that the device 20 is aligned with the object 22. To facilitate engagement of the pole 226 with the retrieval device 20, the example pole coupler 90 is configured to detachably attach the pole 226 to the pole coupler 90. The pole coupler 90 is rigidly connected to the lift bar 78 such that the operator 228 may twist and push the retrieval device 20 and also rotate the pole coupler 90 using the pole 226 to rotate the jaw assemblies 30 and 32 relative to each other as generally described above.

The davit system 222 is then operated to displace out or play out the line 240 such that the retrieval device 20 engages and grasps the object 22 as generally described above. When the retrieval device 20 grasps the object 22, the davit system 222 is operated to displace in or retract the line 240 such that the object 22 is lifted out of the body of water 252 and to a point where rotation of the davit system 222 allows the object 22 to be swung around and into the boat 224. The davit system 222 is again operated to displace out or play out the line 240, allowing the object 22 to be placed on a deck (not shown) of the boat 224.

What is claimed is:

1. A system for displacing a floating object comprising:

at least one jaw assembly operable in an open configuration and a closed configuration;

a latch assembly operable in a latched configuration and an unlatched configuration; and a lift assembly connected to the at least one jaw assembly to allow lifting and lowering of the at least one jaw assembly; whereby the at least one jaw assembly supports the latch assembly such that, when the latch assembly is in the latched configuration, the latch assembly maintains the at least one jaw assembly in the open configuration;

when the at least one jaw assembly is in the open configuration, the at least one jaw assembly defines a jaw gap through which the floating object may pass;

the latch assembly is adapted to engage the floating object when the floating object has passed through the jaw gap such that the latch assembly is placed from the latched position into the unlatched position;

when the latch assembly is placed from the latched position into the unlatched position, the latch assembly allows the at least one jaw assembly to move from the open configuration into the closed configuration; and the at least one jaw assembly is adapted to engage the floating object when in the closed configuration and thereby allow the lifting assembly to displace the at least one jaw assembly and the floating object.

2. A system as recited in claim 1, in which the at least one jaw assembly comprises first and second jaw assemblies.

3. A system as recited in claim 1, in which each jaw assembly comprises:

first and second jaw members; and a main hinge member that rotatably connects the first and second jaw members; whereby the first and second jaw members rotate relative to each other about the main hinge member as the at least one jaw assembly changes between the open configuration and the closed configuration.

4. A system as recited in claim 1, in which the latch assembly comprises:

first and second latch plates defining first and second plate planes, respectively; and a latch pin that rotatably connects the first and second latch plates; whereby the first and second latch plates are configured such that the first and second plate planes are downwardly rotated with respect to horizontal when the latch assembly is in the latched configuration; and the first and second latch plates are configured such that the first and second plate planes are upwardly rotated with respect to horizontal when the latch assembly is in the unlatched configuration.

5. A system as recited in claim 4, in which the latch assembly further comprises at least one release plate extending downwardly from at least one of the first and second latch plates.

6. A system as recited in claim 4, in which:

the latch assembly further comprises a center plate having a first portion rigidly secured to the first latch plate and a second portion;

the second portion engages the second latch plate when the latch assembly is in the latched configuration; and the second portion is disengaged from the second latch plate when the latch assembly is in the unlatched configuration.

7. A system as recited in claim 3, in which the latch assembly comprises:

first and second latch plates defining first and second plate planes, respectively; and a latch pin that rotatably connects the first and second latch plates; whereby the first latch plate is operatively connected to the second jaw members;

the second latch plate is operatively connected to the first jaw members;

the first and second latch plates are configured such that the first and second plate planes are downwardly rotated with respect to horizontal when the latch assembly is in the latched configuration; and the first and second latch plates are configured such that the first and second plate planes are upwardly rotated with respect to horizontal when the latch assembly is in the unlatched configuration.

8. A system as recited in claim 7, in which the latch assembly further comprises at least one release plate extending downwardly from at least one of the first and second latch plates.

9. A system as recited in claim 7, in which:

the latch assembly further comprises a center plate having a first portion rigidly secured to the first latch plate and a second portion;

the second portion engages the second latch plate when the latch assembly is in the latched configuration; and the second portion is disengaged from the second latch plate when the latch assembly is in the unlatched configuration.

10. A system as recited in claim 1, further comprising a spring member for biasing the at least one jaw assembly into the closed configuration.

11. A method for displacing a floating object comprising:

providing at least one jaw assembly operable in an open configuration and a closed configuration, where, when the at least one jaw assembly is in the open configuration, the at least one jaw assembly defines a jaw gap through which the floating object may pass;

providing a latch assembly operable in a latched configuration and an unlatched configuration; and supporting the latch assembly on the at least one jaw assembly such that when the latch assembly is in the latched configuration, the latch assembly maintains the at least one jaw assembly in the open configuration, when the latch assembly is placed from the latched position into the unlatched position, the latch assembly allows the at least one jaw assembly to move from the open configuration into the closed configuration;

connecting a lift assembly to the at least one jaw assembly;

arranging the latch assembly in the latched configuration such that the at least one jaw assembly is in the open configuration; and operating the lift assembly such that the object passes through the jaw gap and engages the latch assembly to place the latch assembly in the unlatched configuration and allow the at least one jaw assembly to move from the open configuration to the closed configuration;

operating the lifting assembly to displace the jaw assemblies and the floating object.

12. A method as recited in claim 11, in which the step of providing at least one jaw assembly comprises the step of providing first and second jaw assemblies.

13. A method as recited in claim 11, in which the step of providing the at least one jaw assembly comprises the steps of:

providing first and second jaw members; and arranging a main hinge member to rotatably connect the first and second jaw members such that the first and second jaw members rotate relative to each other about the main hinge member as the at least one jaw assembly changes between the open configuration and the closed configuration.

14. A method as recited in claim 11, in which the step of providing the latch assembly comprises the steps of:

providing first and second latch plates defining first and second plate planes, respectively; and arranging a latch pin to rotatably connect the first and second latch plates such that the first and second plate planes are downwardly rotated with respect to horizontal when the latch assembly is in the latched configuration; and the first and second plate planes are upwardly rotated with respect to horizontal when the latch assembly is in the unlatched configuration.

15. A method as recited in claim 14, in which the step of providing the latch assembly further comprises the step of arranging at least one release plate to extend downwardly from at least one of the first and second latch plates.

16. A method as recited in claim 14, in which the step of providing the latch assembly further comprises the steps of:

providing a center plate having a first portion and a second portion;

rigidly securing the first portion of the center plate to the first latch plate such that the second portion engages the second latch plate when the latch assembly is in the latched configuration; and the second portion is disengaged from the second latch plate when the latch assembly is in the unlatched configuration.

17. A method as recited in claim 11, further comprising the step of arranging a spring member to bias the at least one jaw assembly into the closed configuration.

18. A system for engaging a floating object comprising:

at least one jaw assembly operable in an open configuration and a closed configuration;

a latch assembly comprising a release plate, the latch assembly being operable in a latched configuration and an unlatched configuration; whereby the at least one jaw assembly supports the latch assembly such that, when the latch assembly is in the latched configuration, the latch assembly maintains the at least one jaw assembly in the open configuration;

when the at least one jaw assembly is in the open configuration, the at least one jaw assembly defines a jaw gap through which the floating object may pass;

the latch plate of the latch assembly is adapted to engage the floating object when the floating object has passed through the jaw gap such that the latch assembly is placed from the latched position into the unlatched position;

when the latch assembly is placed from the latched position into the unlatched position, the latch assembly allows the at least one jaw assembly to move from the open configuration into the closed configuration; and the at least one jaw assembly is adapted to engage the floating object when in the closed configuration and thereby allow the lifting assembly to displace the at least one jaw assembly and the floating object.

19. A system as recited in claim 18, in which each jaw assembly comprises:

first and second jaw members; and a main hinge member that rotatably connects the first and second jaw members; whereby the first and second jaw members rotate relative to each other about the main hinge member as the at least one jaw assembly changes between the open configuration and the closed configuration.

20. A system as recited in claim 18, in which the latch assembly comprises:

first and second latch plates defining first and second plate planes, respectively; and a latch pin that rotatably connects the first and second latch plates; whereby the first and second latch plates are configured such that the first and second plate planes are downwardly rotated with respect to horizontal when the latch assembly is in the latched configuration; and the first and second latch plates are configured such that the first and second plate planes are upwardly rotated with respect to horizontal when the latch assembly is in the unlatched configuration.

21. A system as recited in claim 18, further comprising a spring member for biasing the at least one jaw assembly into the closed configuration.

* * * * *